US008397468B2

(12) United States Patent
McClure

(10) Patent No.: US 8,397,468 B2
(45) Date of Patent: Mar. 19, 2013

(54) SAFETY REINFORCED LIGHT TRANSMITTING PANEL ASSEMBLY

(75) Inventor: Richard R. McClure, Basehor, KS (US)

(73) Assignee: BlueScope Steel North America Corporation, Kansas City, MO (US)

( * ) Notice: Subject to any disclaimer, the term of this patent is extended or adjusted under 35 U.S.C. 154(b) by 578 days.

(21) Appl. No.: 12/106,126

(22) Filed: Apr. 18, 2008

(65) Prior Publication Data

US 2008/0190050 A1 Aug. 14, 2008

Related U.S. Application Data

(63) Continuation-in-part of application No. 11/577,168, filed as application No. PCT/US2006/026628 on Jul. 7, 2006, now Pat. No. 8,061,092.

(60) Provisional application No. 60/699,391, filed on Jul. 15, 2005.

(51) Int. Cl.
*E04G 21/00* (2006.01)
*E04B 1/00* (2006.01)
*E04B 7/18* (2006.01)

(52) U.S. Cl. ..... 52/745.15; 52/200; 52/203; 52/630; 52/783.14; 49/50

(58) Field of Classification Search ..... 52/52, 783.11, 52/783.14, 630, 203, 200, 202, 506.06, 230, 52/98, 100, 745.15, 745.16; 49/50, 57
See application file for complete search history.

(56) References Cited

U.S. PATENT DOCUMENTS

| | | | | |
|---|---|---|---|---|
| 1,236,008 | A | 8/1917 | Rysdon | |
| 2,959,511 | A * | 11/1960 | Finger | 156/183 |
| 3,521,414 | A | 7/1970 | Malissa | |
| 4,080,763 | A | 3/1978 | Naidus et al. | |
| 4,358,916 | A * | 11/1982 | Lacasse | 52/630 |
| 4,471,584 | A | 9/1984 | Dietrich | |
| 4,637,444 | A | 1/1987 | Tanner | |
| 4,680,905 | A | 7/1987 | Rockar | |
| 4,860,511 | A | 8/1989 | Weisner et al. | |
| 5,237,788 | A | 8/1993 | Sandow | |
| 5,406,764 | A * | 4/1995 | Van Auken et al. | 52/408 |
| 5,419,090 | A | 5/1995 | Sandow | |
| 5,675,940 | A | 10/1997 | Bahar et al. | |
| 5,682,713 | A | 11/1997 | Weiss | |
| 5,763,045 | A | 6/1998 | Menzel | |
| 5,787,642 | A | 8/1998 | Coyle et al. | |
| 6,199,330 | B1 | 3/2001 | Cobb | |
| 6,209,271 | B1 | 4/2001 | Kovacs | |

(Continued)

FOREIGN PATENT DOCUMENTS

| | | |
|---|---|---|
| JP | 58-55111 | 4/1983 |
| JP | 62-125145 | 11/1985 |

(Continued)

OTHER PUBLICATIONS

PCT/US06/26628 International Search Report and Written Opinion, Jan. 19, 2007, 5 pages.

(Continued)

*Primary Examiner* — William Gilbert
(74) *Attorney, Agent, or Firm* — Lathrop & Gage LLP

(57) ABSTRACT

A light-transmitting roof panel assembly, having the same shape as adjoining metal roof panels in a standing seam metal roof, includes an outer transparent panel made of a polymeric material and an inner reinforcing panel made of perforated metal. The inner and outer panels nest together and lie flush with the roof. Crimpable side corrugation pieces are attached to the reinforcing panel so that the assembly can be connected to neighboring roof panels by seaming.

9 Claims, 6 Drawing Sheets

U.S. PATENT DOCUMENTS

| | | | | |
|---|---|---|---|---|
| 6,775,951 | B2 | 8/2004 | Gumpert et al. | |
| 7,043,882 | B2 | 5/2006 | Gumpert et al. | |
| 7,134,254 | B1 | 11/2006 | Van Gelder | |
| 2004/0088928 | A1* | 5/2004 | Headrick et al. | 52/98 |

FOREIGN PATENT DOCUMENTS

| | | | |
|---|---|---|---|
| JP | 62-125146 | | 11/1985 |
| JP | 1219246 | A | 9/1989 |
| JP | 11093335 | A | 4/1999 |

OTHER PUBLICATIONS

PCT/US06/26628 Written Opinion of the International Preliminary Examining Authority, Sep. 7, 2007, 5 pages.

Japanese Patent Application No. 2008-521477, English Translation of Notice of Reasons for Rejection dated May 30, 2012, 7 pages.

U.S. Appl. No. 11/577,168, selected pages dated Feb. 26, 2010 through Sep. 28, 2011; 57 pages.

* cited by examiner

Fig. 4
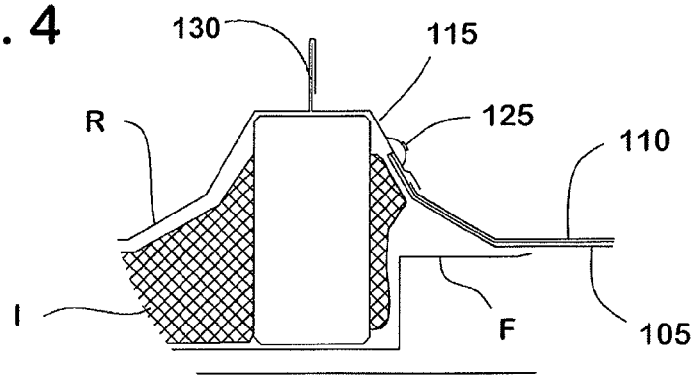
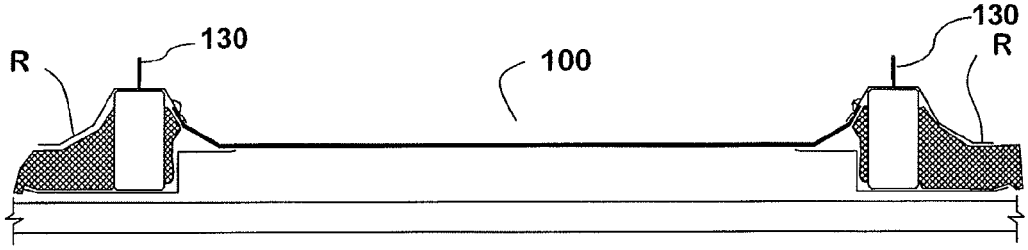
Fig. 3
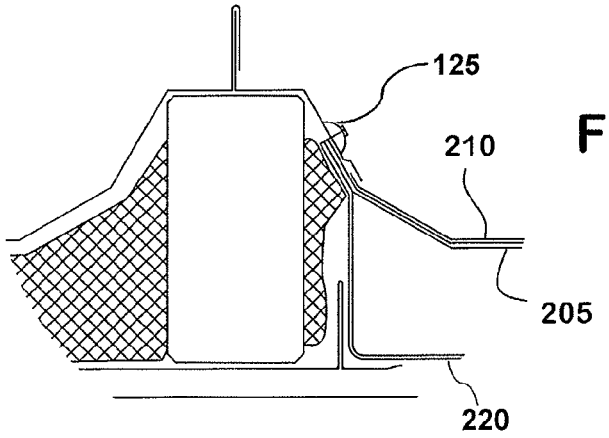
Fig. 6
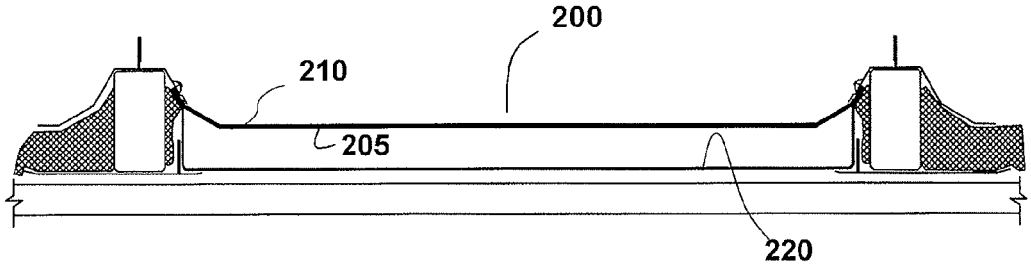
Fig. 5

Fig. 8
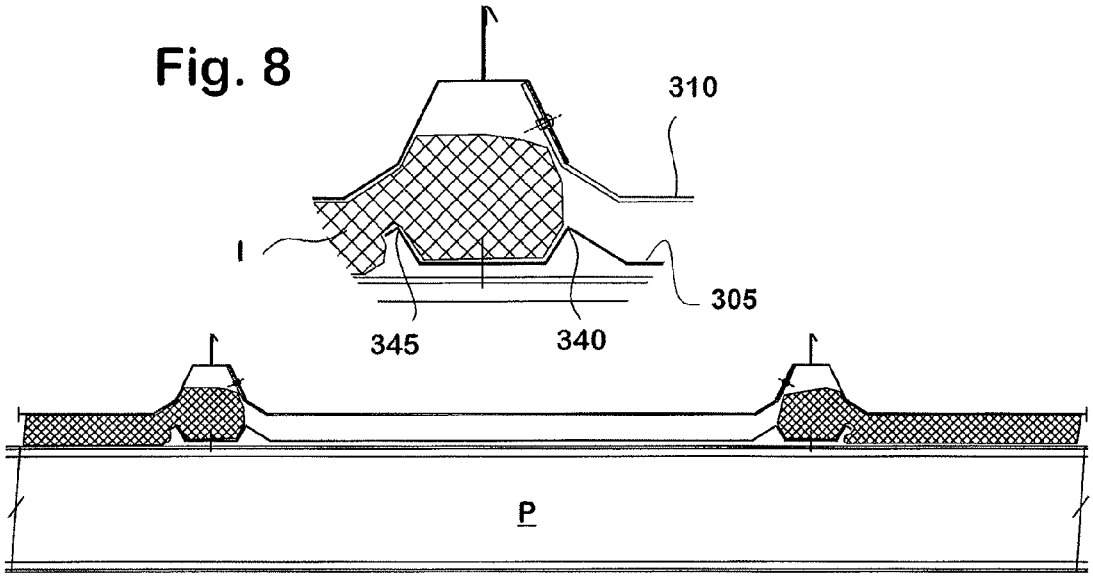
Fig. 7
Fig. 10
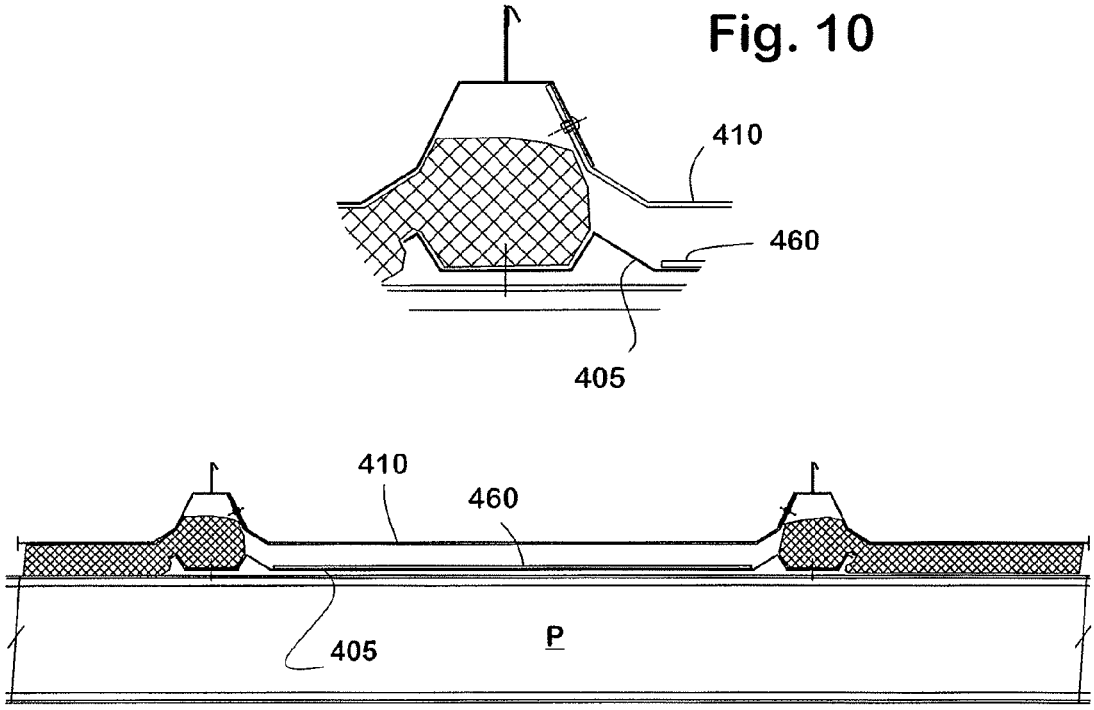
Fig. 9

SAFETY REINFORCED LIGHT TRANSMITTING PANEL ASSEMBLY

CROSS-REFERENCE TO RELATED APPLICATIONS

This application is a continuation-in-part of and claims the benefit of U.S. patent application Ser. No. 11/577,168 filed Apr. 12, 2007 now U.S. Pat. No. 8,061,092 which is a U.S. National Phase Application of PCT/US06/026628, filed Jul. 7, 2006, which claims the priority to U.S. Provisional Patent Application No. 60/699,391 filed Jul. 15, 2005, the disclosures of each being incorporated herein by reference.

BACKGROUND OF THE INVENTION

Industrial buildings often have skylights to provide natural lighting and to conserve energy. For buildings with metal roof systems, skylights or "light panels" may be provided in the roof system. The light panels typically have a clear or translucent sheet material formed into a shape similar to the shape of the structural metal panels of the roof, and metal sides for seaming into a standing seam type metal roof system. The light panels are lapped and sealed to the metal roof panels to provide weather-tight joints. An example of such a panel is shown in FIG. 1.

Because metal roofs typically are insulated underneath with blanket or rigid board insulation, sometimes insulation trim-flashing also is provided to terminate the insulation around the light panel opening. This allows sunlight to come into the building through the light panel.

Current light panels for metal roofing offer no permanent fall protection for people who walk on them. Usually, the light-weight, clear/translucent material of the light panels is, when new, strong enough to support the weight of a typical person and/or light equipment, or the impact from falls or dropped objects. However, as the material ages, it weakens and may lose the ability to support the design weights and impacts. Additionally, years of dirt and or debris may cover the light panel and make it hard for people on the roof to distinguish the light panels from adjacent metal roof panels, thereby increasing the risk of the light panel being stepped on. And in case of fire, the material may melt or weaken, posing a risk to a roof-borne firefighters.

Building authorities have attempted to resolve these safety issues by requiring that new building roofs have skylights installed on a roof curb, thereby elevating the light panel above the plane of the roof, and/or that security bar systems (FIG. 2) be installed over the light panel.

Both of these approaches make it easier to know where the light panels are on a roof, and both deter people from walking or standing on them. However, the additional material and labor required to implement these safety features on each of the many light panels of a large building are great.

Complicating the growing need for safer skylights that have inherent structural strength to avoid personnel or equipment fall-throughs, building codes are increasing the amount of roof area that is permitted or required to transmit light.

Thus, what is needed is a roof panel that maximizes light transmission while providing a sufficiently strong structure over the years, even in case of fire, to prevent people or equipment from falling through it.

SUMMARY

To provide a light panel with sufficient strength, the invention provides a light-transmitting metal reinforcing panel beneath a non-metallic light-transmitting panel. The metallic panel is perforated so that it transmits light, and, throughout a wide temperature range, supports prescribed loads and withstands prescribed impacts. The non-metallic panel is preferably made of a transparent polymer.

In one embodiment of the invention, the metal reinforcing panel is shaped to nest closely with the non-metallic panel. In another embodiment, the panels are separated a substantial distance.

Yet another embodiment of the invention includes a first light-transmitting panel configured to mount on a roof and a second light-transmitting panel configured to provide insulation trim flashing, below the first panel.

Other features and advantages of the invention will become apparent from the following description of the preferred embodiment, which refers to the accompanying drawings.

BRIEF DESCRIPTION OF THE SEVERAL VIEWS OF THE DRAWINGS

The invention is described in detail below with reference to the following figures, throughout which similar reference characters denote corresponding features consistently, wherein:

FIG. 3 is a cross-sectional view of a first embodiment of the invention, taken on a plane perpendicular to the length of the panel;

FIG. 4 is an enlargement of a portion of FIG. 3;

FIG. 5 is a cross-sectional view of a second embodiment of the invention;

FIG. 6 is a enlargement of a portion of FIG. 5;

FIG. 7 is a cross-sectional view of a third embodiment of the invention;

FIG. 8 is an enlargement of a portion of FIG. 7;

FIG. 9 is a cross-sectional view of a fourth embodiment of the invention;

FIG. 10 is an enlargement of a portion of FIG. 9;

DETAILED DESCRIPTION OF THE PREFERRED EMBODIMENTS

Figure 1:
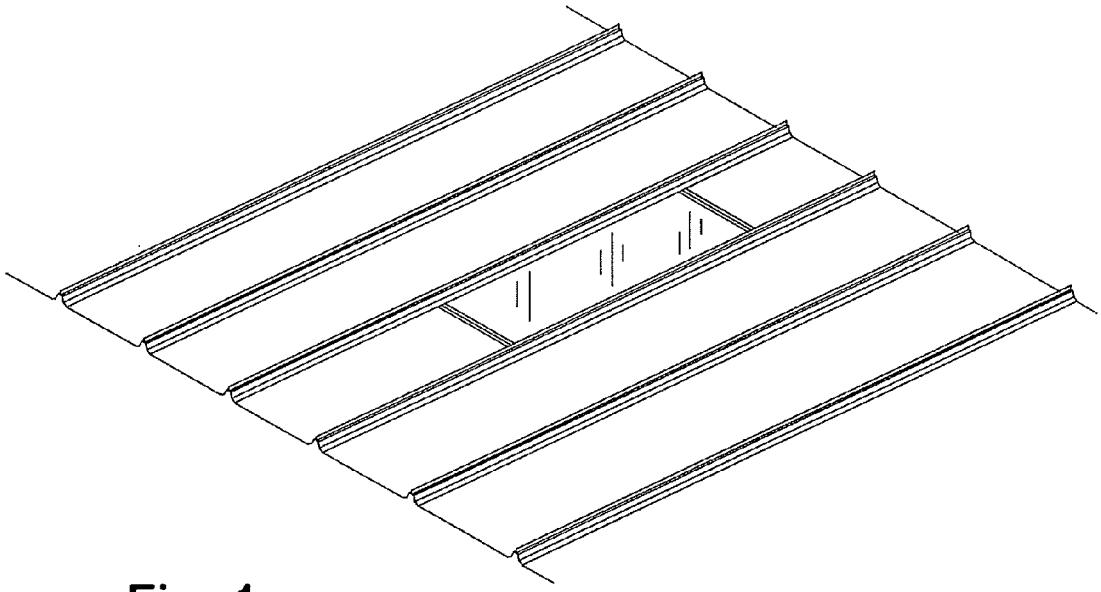
Fig. 1 (PRIOR ART)
FIG. 1 is a perspective view of a conventional flush skylight in a roof.
Figure 2:
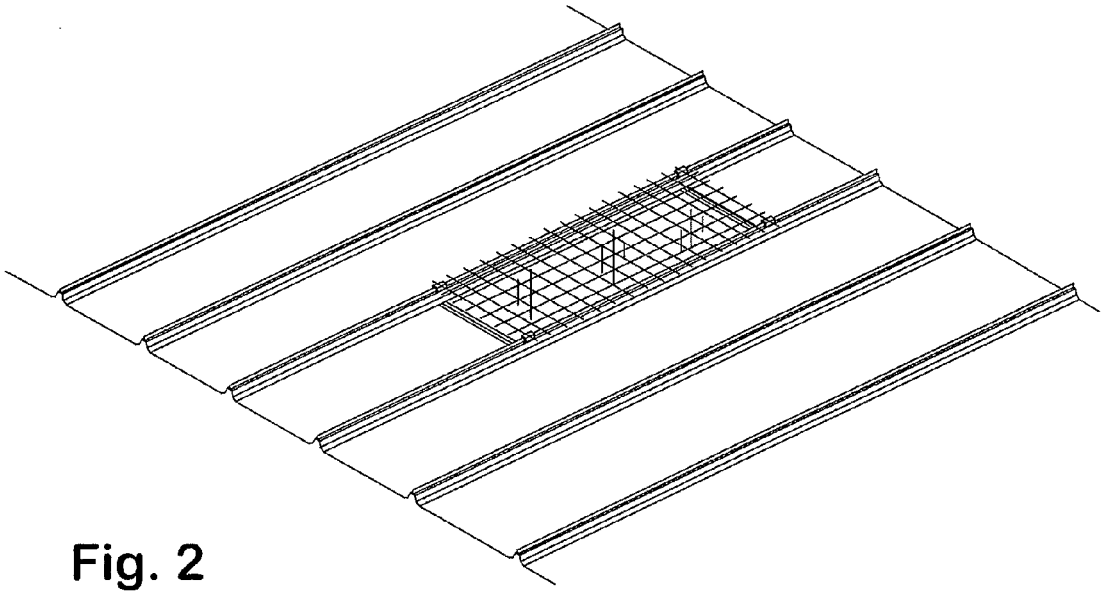
Fig. 2 (PRIOR ART)
FIG. 2 is a perspective view of a conventional heavy wire grid disposed over a skylight.

Referring to FIG. 3, a safety reinforced light transmitting panel assembly 100 embodying the invention includes a reinforcing panel 105 (see detail in FIG. 4) nested below a similarly shaped light-transmitting panel 110. A side corrugation 115 is connected by fasteners such as rivets 125 to both the reinforcing panel and the light-transmitting panel. The side corrugation 115 is used to connect the assembly to adjoining roof panels R during installation.

The reinforcing panel is, preferably, constructed of a strong, light gauge perforated metal and is shaped to nest with the light-transmitting panel. The reinforcing panel is intended to support the weight of a person if the light-transmitting panel breaks or melts during a fire. The alloy, dimensions and the gauge of the metal are chosen so that, throughout a wide prescribed temperature range, the reinforcing panel will have strength sufficient to withstand the weight of people stepping on the assembly, and reasonably anticipated impacts from people or equipment falling on it.

Figure 11:
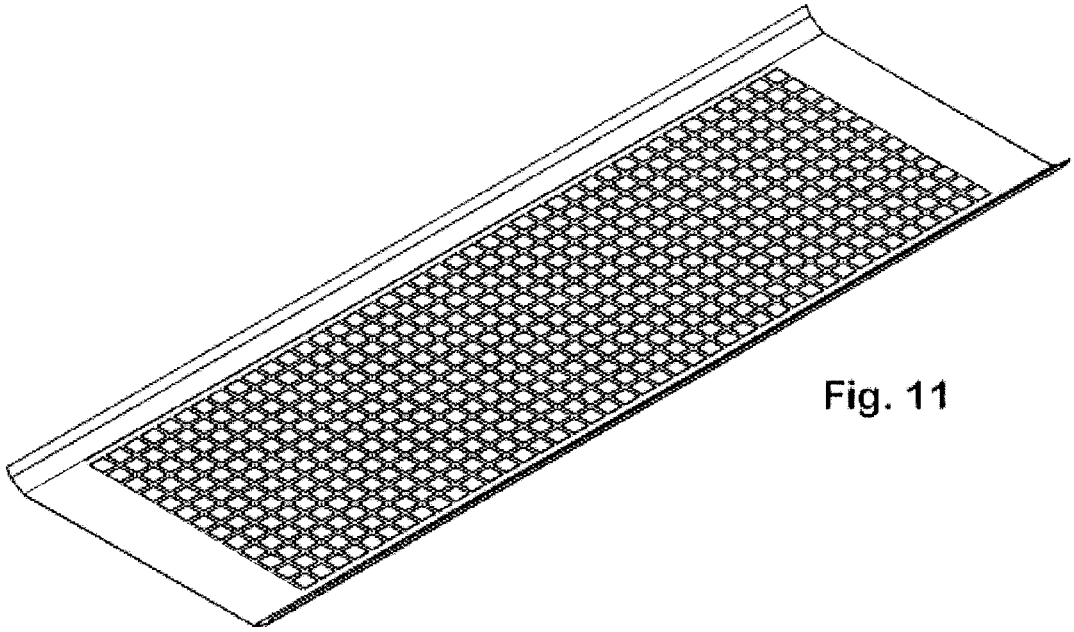
FIGS. 11 and 12 show alternative forms of a perforated metal reinforcing panel.
Figure 12:
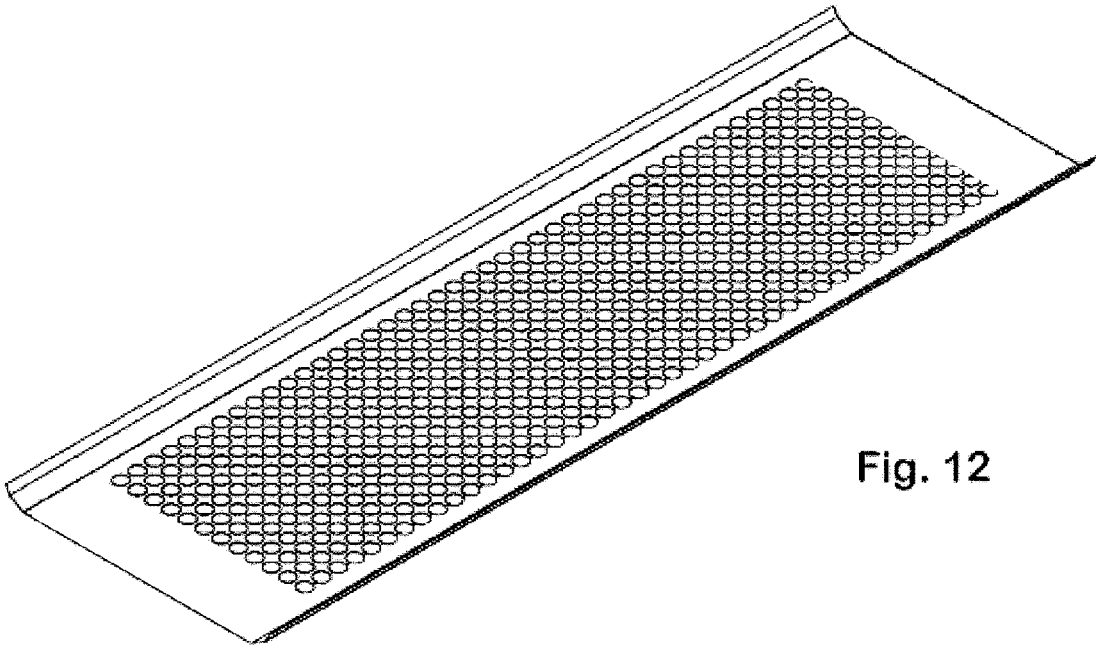

The reinforcing panel 105 has openings or perforations 120 that allow light from the light-transmitting panel 110 to pass through. The perforations, examples of which are seen in FIGS. 11 and 12, can vary in shape, size and configuration, as long as design strength criteria are met. The perforations preferably take up at least 50% of the surface area of the panel, so that the panel transmits at least 50% of the light falling upon it.

The light-transmitting panel 110 is designed to have substantially the same cross-sectional shape as the adjoining roof panels R, which may for example be MR-24® roof panels, made by Butler Manufacturing Co. Since the light-transmitting panel assembly 100 is a geometric substitute for a metal roof panel, the light panels can be placed anywhere on the roof.

The light-transmitting panel 110 may be constructed of a glass fiber reinforced polyester panel, such as the LitePanl® made by Butler Manufacturing Co. Preferably, however, the light-transmitting panel is constructed of polycarbonate, acrylic plexiglass or other polymeric material which has good clarity and provides impact resistance. Such materials have a greater light transmission than glass-reinforced plastic. With substantially transparent materials, the overall light transmission of the assembly, even accounting for the light blocked by the reinforcing panel, is as good or better than current translucent panels.

Nesting the light-transmitting panel with the reinforcing panel promotes flushness that discourages dirt from collecting and insects from nesting. Close contact between the light-transmitting panel and the reinforcing panel also supports the light-transmitting panel during even the slightest deflections, thereby preventing breakage that might otherwise occur.

The side corrugation 115 facilitates installing the light-transmitting panel 110, with or without a reinforcing panel 105, in a seamed roof. In the Butler Manufacturing Co. MR-24® and other similar roofing systems, the metal panels making up a roof have pre-formed edge flanges designed to interfit with complementary flanges on neighboring panels. The flanges are fit together and then are joined by crimping to form a water-tight, vapor-retarding seam.

The perforated reinforcing panel is preferably constructed of an alloy which is stronger than the neighboring roof panels. Strong materials are generally less ductile, so conventional crimping could cause the material to fail. To avoid material failures, yet provide substantially the same properties as the other seams formed in roof, the side corrugation 115 is made of a more ductile metal, and is attached to the light-transmitting panel 110 with rivets 125 or other suitable fasteners. The side corrugation provides a crimpable flange portion 130 that can safely be joined by seaming to adjacent roof panels.

The rivets 125 firmly interconnect the side corrugation 115, the reinforcing panel 105 and the light-transmitting panel 110. Preferably, mastic (not shown) is placed between the panels at the edges so that, when the side corrugation is seamed with adjacent roof panels, the safety reinforced light transmitting panel assembly provides a water-tight seal consistent with the rest of the roof.

As shown in FIG. 4, trim flashing "F" is installed across the purlins below the edges of the panels, to retain the insulation "I" and conceal it from view, thus providing a finished appearance.

In a second embodiment of the invention, illustrated in FIGS. 5 and 6, the roof panel assembly 200 includes a reinforcing panel 205 nested below a light-transmitting panel 210.

In this embodiment, however, there is an additional transparent polymeric panel 220 which has a trough shape so that a substantial volume of air is trapped between the upper and lower panels 210, 220.

FIG. 7 shows a third embodiment, in which the reinforcing panel 305 has ribs 340, 345 which act as substitutes for the trim flashing F in confining and concealing the insulation. The adjacent ribs 340, 345 together define a channel which reinforces the panel against lengthwise bending, making it not only strong enough to withstand reasonably expected or prescribed loads and impacts throughout the prescribed temperature range. The inner rib 340 confines the edge of the insulation "I" to provide a pleasing look, which the outer rib 345 bites into or compresses the insulation to keep it in place. This compression also discourages moisture from entering and degrading the insulation. If desired, an adhesive (not shown) may be used to connect the insulation facing to the rib 340.

A fourth embodiment of the invention is shown in FIGS. 9 and 10. Here, a second light-transmitting panel 460 is placed between the transparent panel 410 and the reinforcing panel 405. The second light-transmitting panel 460 is constructed of any substantially transparent material, possibly the same material as the light-transmitting panel 410. In FIG. 10, the lower panel 460 is shown resting on the reinforcing panel 405, but other arrangements are possible. The plural transparent panels capture a pocket of dead air, insulating the building interior from exterior temperatures. The pocket also reduces condensation and deposits that would otherwise form following condensation on the light-transmitting panel, thus maintaining good light transmission.

Figure 13:
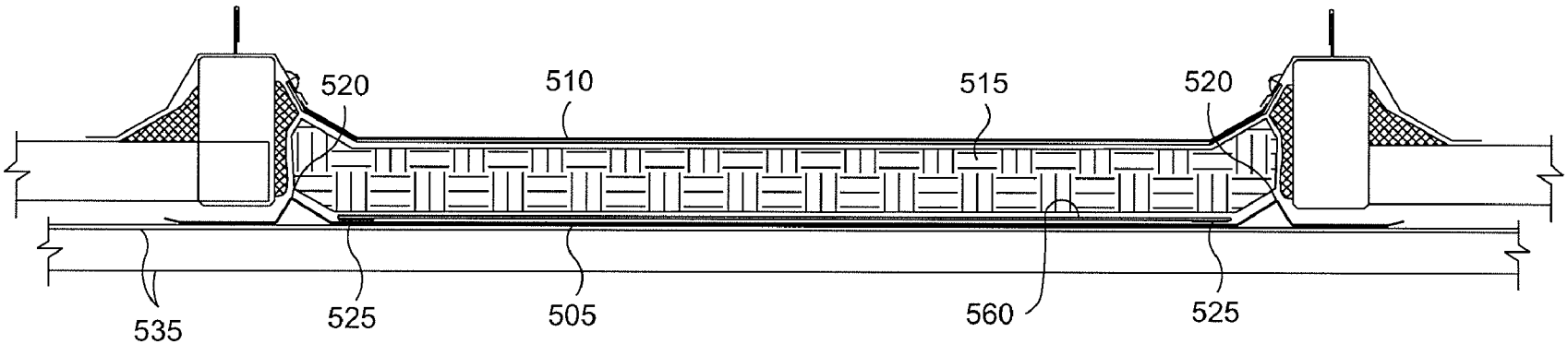
FIG. 13 shows a fifth embodiment of the invention.
Figure 14:
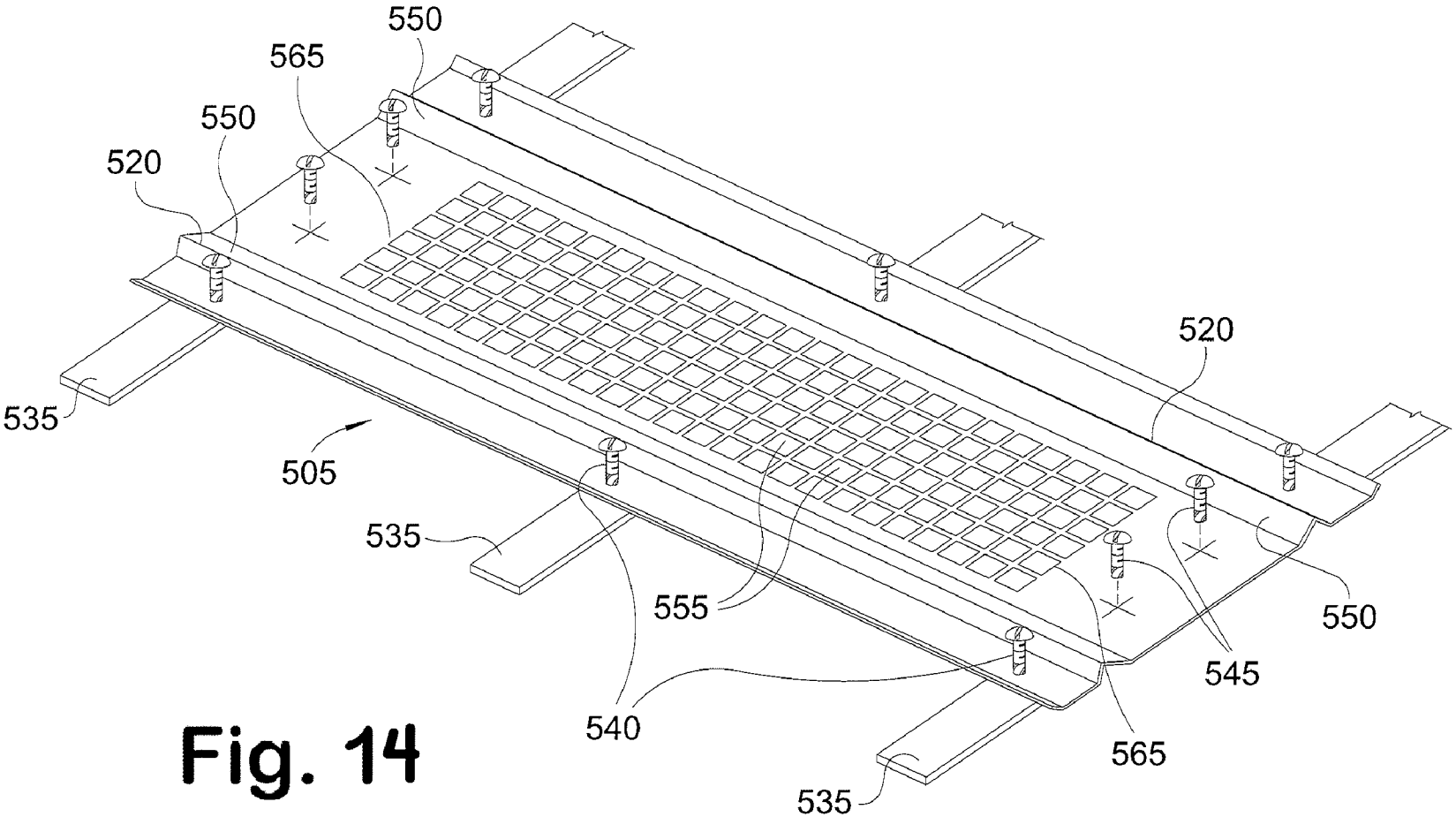
FIG. 14 shows the perforated metal reinforcing panel used with the fifth embodiment.

A fifth embodiment of the invention is shown in FIGS. 13-14. The fifth embodiment is like the embodiment disclosed in FIGS. 9-10 in that a second light-transmitting panel 560 is placed between the transparent panel 510 and the reinforcing panel 505. The second light-transmitting panel 560 is secured on top of reinforcing panel 505 using thermally sealing adhesive strips 525. Alternatively, an adhesive alone, or fasteners could be used. The details of reinforcing panel 505 are shown in perspective in FIG. 14. Light transmitting panel 560 is constructed of translucent material, possibly the same material as the light-transmitting panel 510. Alternatively, one or both of panels 510 and 560 could be substantially transparent depending on the lighting effect desired. Like with the last embodiments, the panels 510 and 560 together close off a chamber which (i) substantially captures a pocket of dead air, thus insulating the building interior from exterior environmental conditions; and (ii) reduces condensation.

Unlike the earlier embodiments, however, the FIG. 13 embodiment includes a dual-functioning intermediate material 515 which is contained in the space defined between panels 510 and 560. The material selected may be one of light-diffusing and thermally insulating, but preferably it is both. In the embodiment disclosed in FIG. 13, a glass fiber material is used which is translucent. One example of a material that is readily commercially available and can be used as material 515 is a simple translucent glass fiber material which is manufactured by Owens Corning as well as other manufacturers. Other similar materials could be used instead, however.

A first function of material 515 is to act as a light diffuser. The substantially direct sunlight allowed through a conventional transparent window (i) provides a smaller area of illumination, and (ii) cause more HVAC burden inside the building structures on which they are used. When intermediate material 515 is used, however, the material diffuses the light, speading it out such that the building is more uniformly illuminated, and does not seasonably burden the building's HVAC system to as great an extent.

A second function of intermediate material 515 is that it acts as a thermal insulator. Although the pocket of dead air created between panels 510 and 560 already insulates to a degree, material 515 increases the insulative properties even more so. Thus, intermediate material acts as both a diffuser and a thermal insulator to improve overall functionality in many instances.

Alternative materials can be used instead of the glass fiber insulator disclosed. For example, one alternative material which could be used in the space created between panels 510 and 560 is some sort of silicon-based aerogel product. One such transparent/translucent material is marketed by the Cabot Corporation under the trade name Nanogel® translucent aerogel. It will be understood to those skilled in the art that other alternative materials could be used as well.

In terms of installation, this embodiment is installed in much the same way as are the other embodiments discussed above. First, the reinforcing panel 505 is installed on an existing roof structure, e.g., secondary structural members 535, at its edges using some sort of fasteners, e.g., screwbolts 540 and as shown in FIG. 14, or some other fastening devices or means. Translucent panel 560 can be adhered onto the reinforcing panel 505 using adhesive strips 525 either before or after the reinforcing panel 505 is secured to the secondary structural members, e.g., member(s) 535. It should be noted that the structural members 535 have been oversimplified in the figure. Even though they are shown as a horizontal member, this member could represent the top portion of a truss-type support, the top portion of a Z-shaped purlin, or any other sort of building structural member. One skilled in the art will recognize that numerous sorts of supports exist, and that the disclosed Safety window technologies are useful with numeorus structural arrangements and should not be limited to any particular sort of support structure. Panel 560 may also be adhered to the reinforcing panel after blanket insulation is laid down and cut out. To lay down it down, the blanket insulation is spread over the entire reinforcing panel and surrounding areas. A hole is then cut in the blanket using a pair of longitudinally extending knife-receiving corrugations 520 provided in the two longitudinal edges of the reinforcing panel. The user, inserting a knife into each of the edges and running it along the length of reinforcing member 505 is able to easily cut the lateral edges of the window hole out of the insulation blanket. The end cuts in the insulation blanket are easier to make, thus a knife guide is not necessary to make them, but the panel ends can serve as a cutting guide.

Once the hole is cut in the insulation blanket, adhesive strips 525 are used at the margins in between the perforated section 555 and ramped portions 550. Adhesive strips are also applied at margins 565 at each end of the perforated section 555. Once these adhesive strips are applied, the light transmissive panel 560, which is sized to overlap the margins, is placed on top of the perforated section so that its edges are secured by the adhesive strips.

With panel 560 now adhered, the glass fiber insulator is placed on top of it. Once the insulation has been included, the lateral edges of light transmissive panel 510 are secured using clip devices as discussed with earlier embodiments.

The clip devices are adapted to receive and secure the edges of the first light-transmissive panel 510 so that it is installed directly above but in spaced relation to light transmitting panel 560 creating a closed off chamber in which the intermediate diffusive/insulative material 515 (e.g., glass fiber insulation) will reside.

While the invention is described in context with Butler Manufacturing Co. products, for which it may be best suited, the invention is adaptable for use with other metal roof panels and systems.

Inasmuch as the invention is subject to many variations and modifications, it is intended that the foregoing description and the drawings should be regarded as only examples of the invention defined by the following claims.

The invention claimed is:

1. A method of creating a skylight in a roof, said method comprising:

attaching a plurality of edges of a discontinuous metal reinforcing panel onto a supporting roof structure;

securing a first continuous light transmitting panel above said discontinuous metal reinforcing panel with at least one of an adhesive strip, fastener, and adhesive;

installing a second continuous light transmitting panel a distance above said first continuous light panel to define space between said first and second light transmitting panels;

inserting a material which is both diffusive and insulative into said space;

substantially sealing said space from an outside environment to trap therein a pocket of dead air along with said material; and orienting said first, second, and said reinforcing panels such that at least some light is able to pass through said panels into said building.

2. The method of claim 1 comprising:

picking a translucent glass fiber substance to comprise said material.

3. A skylight installation method comprising:

attaching a plurality of edges of a discontinuous metal reinforcing panel onto a supporting roof structure, said reinforcing panel having a length and a width, a substantially flat middle portion, a lateral pair of edges running the length of said reinforcing panel, and an end pair of edges on each end of said reinforcing panel;

forming a pair of longitudinally-extending knife-guiding ridges which extend upward along each lateral edge of said reinforcing panel;

providing a sheet of insulation for installation around said skylight; and presenting said knife guiding ridges to a user as a means to cut edges for a profile of said skylight out of said sheet of insulation when the insulation is being installed around the skylight on a building.

4. The method of claim 3 comprising:

installing a first continuous light transmitting panel above said discontinuous metal reinforcing panel.

5. The method of claim 3 comprising:

installing a second continuous light transmitting panel a distance above said first continuous light panel to define a fillable air pocket between said first and second light transmitting panels; and orienting said first, second, and said reinforcing panels such that at least some light is able to pass into said building.

6. The method of claim 5 comprising:

inserting a material which is one of diffusive and insulative into said fillable air pocket.

7. A roof panel system for creating a skylight on a building, said system comprising:

a rigid discontinuous metal reinforcing panel, a plurality of edges of said reinforcing panel being adapted to be secured to a supporting roof structure;

a first continuous light transmitting panel secured to and atop said discontinuous metal reinforcing panel;

a second continuous light transmitting panel located a distance above said first continuous light transmitting panel, said distance creating a space between said first and second light transmitting panels;

said first, second, and said reinforcing panels together being oriented in a way in which at least some light is able to pass through said panels into said building; and an intermediate material disposed in said space, said intermediate material being both (i) a diffuser and, (ii) an insulator;

wherein said space is substantially sealed off from an outside environment after disposal of said intermediate material into said space to trap in said space a pocket of air along with the intermediate material;

wherein the first and second continuous light transmitting panels are constructed to provide impact resistance.

8. The roof panel system of claim 1, wherein system forms a vapor retarding seal against said outside environment.

9. The roof panel system of claim 1 wherein said intermediate material is constructed of translucent glass fibers; and wherein the first continuous light transmitting panel is secured to said metal reinforcing panel with at least one of an adhesive, adhesive strip, and fastener.

* * * * *